United States Patent [19]

Shida

[11] Patent Number: 4,835,930

[45] Date of Patent: Jun. 6, 1989

[54] METAL ROOFING AND SIDING PANEL

[75] Inventor: Hiroshi Shida, Tokyo, Japan

[73] Assignee: Sky Aluminium Co., Ltd., Tokyo, Japan

[21] Appl. No.: 211,037

[22] Filed: Jun. 24, 1988

[30] Foreign Application Priority Data

Jun. 24, 1987 [JP] Japan ..... 62-96811[U]

[51] Int. Cl.[4] ..... E04D 1/06

[52] U.S. Cl. ..... 52/539; 52/519; 52/529

[58] Field of Search ..... 52/519, 528, 529, 530, 52/531, 538, 539

[56] References Cited

U.S. PATENT DOCUMENTS

| | | | |
|---|---|---|---|
| 202,953 | 4/1878 | Merrill | 52/519 X |
| 1,772,924 | 8/1930 | Weller | 52/519 |
| 2,127,392 | 8/1938 | Copeland | 52/528 |
| 2,243,256 | 5/1941 | Miller | 52/530 |
| 2,376,024 | 5/1945 | Barrett | 52/528 |

*Primary Examiner*—David A. Scherbel
*Assistant Examiner*—Anthony W. Williams
*Attorney, Agent, or Firm*—Oblon, Spivak, McClelland, Maier & Neustadt

[57] ABSTRACT

A metallic panel for use in a roof, for example, is disclosed. It comprises a part (second part) destined to be left exposed even after the metallic panel is overlaid by another metallic panel and a part (first part) destined to be overlaid by the second part of the other metallic panel. The boundary between the first part and the second part is so constructed as to be joined fast to the lower edge of the second part of another metallic panel. The metallic panel is provided along the edge of the first and second parts respectively with a rising rib formed by bending the edge in an upper inward direction and a falling rib formed by bending the edge in a lower inward direction. It is further provided on the surface of the first part with a plurality of oblong reinforcing protuberances arrayed parallelly in the vertical direction.

4 Claims, 4 Drawing Sheets

METAL ROOFING AND SIDING PANEL

BACKGROUND OF THE INVENTION

1. Field of the Invention

This invention relates to metal roofing and siding panels to be used in covering the roof or exterior wall of a building after the pattern of platelike slates.

2. Prior Art Statement

Conventional metallic roofing and siding panels used for covering roofs of buildings come in various kinds. The present inventor has already proposed several kinds of metallic roofing and siding panels of the class. The metallic panel disclosed in Japanese Utility Model Registration Application SHO 61(1986)-160233, for example, is a pentagonal product formed by pressing a thin metallic plate and corrosion-proofed by a surface treatment. As illustrated in FIG. 13 to FIG. 15, this metallic panel 1 consists of an underlying part A forming an upper part of the panel (the upper lefthand part in the position of FIG. 13) and destined to be overlaid by another metallic panel 1 and an exposed part B forming a lower part of the panel and destined to be left exposed after the covering of a roof is completed. A rising rib 2 bent substantially perpendicularly upwardly is formed along the edge of the underlying part A and a falling rib 3 bent substantially perpendicularly downwardly is formed along the edge of the exposed part B in the lower part of the panel. Further, cylindrical bosses 4 adapted for a nail to be driven therein are formed on the underlying part A of the metallic panel 1.

The covering of a roof with metallic panels 1 is accomplished by fastening metallic panels 1 side by side in one row along the lower edge of the roof to a roof sheathing 6 or rafters 7 of the roof by driving nails 5 into nail holes of the cylindrical bosses 4 formed plurally on the underlying part A of each metallic panel 1, similarly fastening metallic panels 1 side by side in a row in such a manner as to have the exposed parts B thereof cover the upper surfaces of the underlying parts A of the metallic panels 1 in the first row, and repeating this procedure on the successive rows from the lower to the upper end along the inclination of the roof until the roof is wholly covered (FIG. 14 and FIG. 15).

The metallic panel disclosed in Japanese Utility Model Application SHO 61(1986)-194123 is an improved version of the metallic panel described above, the improvement consisting in having a plurality of oblong reinforcing protuberances formed on the panel surface in the vertical direction of the metallic panel 1. The metallic panel disclosed in Japanese Utility Model Application SHO 61(1986)-194124 is an improved version of the aforementioned metallic panel 1, the improvement consisting in having the metallic panel 1 folded at the boundary between the underlying part and the exposed part in a Z-shaped cross section so that the lower end of the underlying part overhangs the upper end of the exposed part and having formed at the end part of the falling rib on the lower end side of the exposed part an engaging part adapted to take hold of the Z-shaped fold formed on another metallic panel placed beneath the metallic panel under discussion. The metallic panels of the three kinds described above invariably have the exposed parts thereof left exposed after the covering of a roof or an exterior wall is completed so that the roof or exterior wall will assume a pleasing appearance as a whole.

In the case of the conventional metallic panel 1 described above, since the rising rib 2 and the falling rib 3 are both bent perpendicularly, the metallic panel 1 entails the possibility that, during a storm, rainwater leaking through the joined parts of adjacent panels will flow over these ribs and reach the roof sheathing. Further since the upper ends of the ribs of the metallic panel perpendicularly contact the surfaces of the other metallic panels laid thereon, this metallic panel has the disadvantage that the upper end surfaces of the ribs will through collision and sliding friction, inflict damage upon the finished surfaces of the metallic panels. When a person stands on the metallic panels or walks on the surface of a completed roof, for example, there is the possibility that the portions of metallic panels which are not in contact with the other metallic panels will be dented to such an extent as to impair the appearance of the metallic panels.

OBJECT AND SUMMARY OF THE INVENTION

In the light of the various drawbacks suffered by the conventional metallic panels as described above, the present invention aims to provide a metal roofing and siding panel which ensures reliable discharge of the rainwater leaking through the joined parts of adjacent metallic panels and ensures protection of the roof against leakage of rain, facilitates relative positioning of metallic panels during the covering of a roof or an exterior wall, and precludes the possibility of the upper ends of rising ribs and falling ribs inflicting damage upon the surface of the adjoining metallic panels and causing deformation of such adjoining metallic panels.

To accomplish the object described above, this invention is directed to a metal roofing and siding panel comprising a first part and a second rectangular part having the upper edge thereof integrally connected to the lower edge of the first part and having the obverse side thereof left exposed as disposed in covering a roof or an exterior wall, so that during the covering of the roof or exterior wall, the obverse side of the first part of the metallic panel is caused to contact the reverse side of the second part of another metallic panel and the reverse side of the second part of the present metallic panel to contact the obverse side of the first part of yet another metallic panel, which metal roofing and siding panel is characterized by the fact that the first part is provided along the edge thereof with a rising rib formed by folding the edge portion thereof in an upper inward direction, that the second part is provided along the opposite lateral edges and lower edge thereof with a falling rib formed by folding the corresponding edge portions thereof in a lower inward direction, that the first part is provided on the obverse side thereof with a plurality of oblong reinforcing protuberances extended parallelly in the vertical direction, and that the lower edge of the first part and the upper edge of the second part are connected with a folded structure adapted to keep hold of the falling rib formed along the lower edge of the second part of another metallic panel.

A modification having the rising rib and the falling rib mentioned above each provided with an inwardly extended portion; a modification having the first part thereof formed in the shape of an isosceles triangle including as the base thereof the lower edge of its own connected to the upper edge of the second part; a modification having the first part thereof formed in the shape of an isosceles triangle, having the rising rib along the edge formed on portions except for the apex and the neighboring portions thereof, and having an arcuate combination reinforcing and water-stopping protuberance formed along the cut in the rising rib between the oblong reinforcing protuberances and the apex; a modification having the two middle-most oblong reinforcing protuberances separated by a distance required for joining the falling ribs of two other metallic panels placed side by side as held in contact with the obverse side of the first part; and a modification having the reinforcing protuberances formed in a height substantially equal to the height of the rising ribs and the falling ribs are embraced by the present invention.

DETAILED DESCRIPTION OF THE PREFERRED EMBODIMENTS

Figure 1:
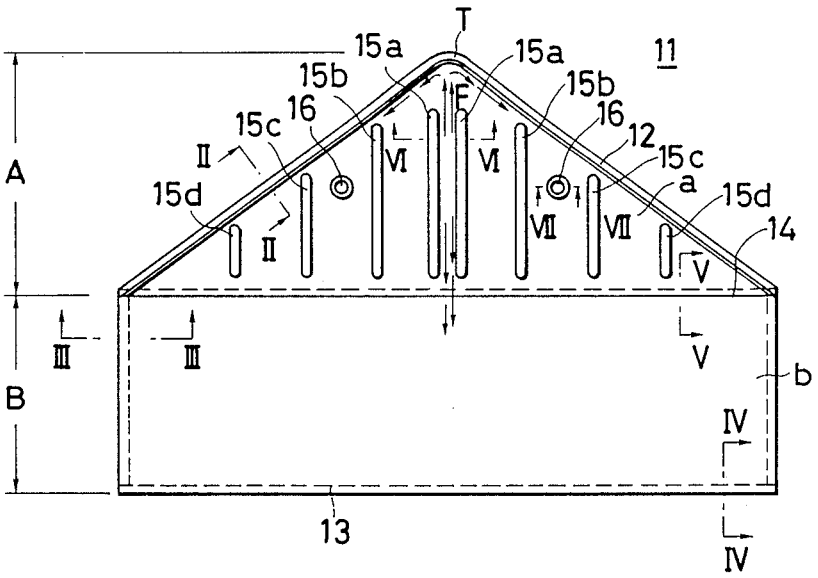
FIG. 1 is a plan view of typical metallic panel as the first embodiment of this invention, FIG. 2 a cross section taken through FIG. 1 along the line II—II, FIG. 3 a cross section taken through FIG. 1 along the line III—III, FIG. 4 a cross section taken through FIG. 1 along the line IV—IV, FIG. 5 a cross section taken through FIG. 1 along the line V—V, FIG. 6 a cross section taken through FIG. 1 along the line VI—VI, and FIG. 7 a cross section taken through FIG. 1 along the line VII—VII.

Now, the present invention will be described below.

The angle at which the rising rib of the first part and the falling rib of the second part are bent inwardly is less than about 80 degrees, preferably in the range of 60 to 45 degress. It can be selected suitably in due consideration of the strength, elasticity, etc. of the metallic panel being contemplated.

Where the rising rib and the falling rib are further provided with an inwardly extended portion, the length of this extension is sufficient approximately in the range of 1 to 5 mm, for example. To facilitate the work involved in forming the extended portions, this length may be approximately in the range of 10 to 15 mm. Though the extended portions are desired to be parallel to the panel surface, this is not an essential requirement.

When the first part is formed in the shape of a triangle and the rising rib on the first part is bent inwardly, the bending work in the neighborhood of the apex requires strong plastic deformation of the metallic material. The bending work cannot be easily carried out if the metallic material is deficient in ductility. In such case, in the portion of the rising rib in the neighborhood of the apex of the triangle mentioned above, it is desirable to cut off the portion of the rising rib wholly or at least the portion extended in the inward direction from the top end of the rib and form an arcuate reinforcing protuberance on the upper side of the first part inside the cut portion along the entire length thereof.

When the first part of the metallic panel is in the shape of a triangle, the perpendicular drawn from the central apex to the base of the triangle falls where the lateral falling ribs of two other metallic panels laid side by side as laid on the first metallic panel adjoin each other. When two reinforcing protuberances are disposed parallelly to the perpendicular mentioned above in such a manner that they are separated by a distance required for joining the falling ribs of the other two metallic panels placed side by side, the relative positioning of the metallic panels can be attained reliably and easily during the work of covering a roof or an exterior wall. The two reinforcing protuberances mentioned above serve the purpose of preventing rainwater which has leaked through the gap between the adjoining falling ribs of the two metallic panels placed side by side as laid over the metallic panel containing the reinforcing protuberances from spreading over the entire panel surface.

The reinforcing protuberances are not required to have the same height as the rising rib and the falling rib. They are effective in fulfilling the purpose even if they have a smaller height than the two ribs. Practically, however, it is desirable that the protuberances should formed in the same height as the two ribs.

In the metallic panel constructed as described above, the rising rib and falling rib formed by bending the edge portions of the metallic panel inwardly intercept the rainwater impinging on the panel surface and tending to flow out of the panel and consequently ensuring perfect prevention of leakage of rain through the roof.

When a fold is formed in a cross section of the letter Z along the boundary between the first part and the second part so as to take hold of an engaging portion formed at the lower end of the second part of another metallic panel laid over the first metallic panel, the otherwise possible leakage of rainwater through the lower end of the metallic panel during a storm can be prevented.

When the rising rib and the falling rib are provided at the leading ends thereof with an inwardly extended portion, the extended portions further ensure perfect prevention of leakage of rainwater through the roof by intercepting the outward flow of rainwater on the panel surface and, at the same time, prevent the upper and lower ends of the ribs from inflicting damage upon the finished metallic panels. Even when a load is exerted upon the metallic panels as when a person walks on the roof surface, these extended portions serve the purpose of preventing the panel surfaces from sustaining deformation such as heavy sagging.

When the first part is formed in the shape of a triangle and the portion of the rising rib in the neighborhood of the apex of the triangle is cut off, the apex portion of the first part can be formed without entailing any strong plastic deformation. In other words, the rising can be formed with ease.

When two reinforcing protuberances are parallelly formed symmetrically relative to the center line of the panel as separated by a distance required for joining the two falling ribs, they serve the purpose of preventing leakage of rainwater through the roof by keeping the impinging rainwater from diffusion, concentrating the rainwater, and causing the concentrated water to flow down the roof surface. Further, these two reinforcing protuberances serve the purpose of ensuring and facilitating the relative positioning of other metallic panels to be laid thereon.

Further when the rising rib, the falling rib and the reinforcing protuberances are all formed in the same height, the finished roof acquires a smooth surface, offers great strength against loads and enhances the effect of preventing rainwater leakage.

The discharge of rainwater is facilitated and the protection of the roof sheathing against direct contact with rainwater is ensured by interposing a larger distance between the apex and the lower edge of the first part than between the upper edge and the lower edge of the second part.

Now, embodiments of the present invention will be described below with reference to FIG. 1 through FIG. 12.

Figure 3:
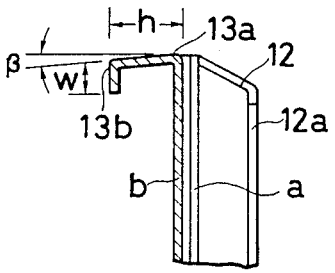
Figure 4:
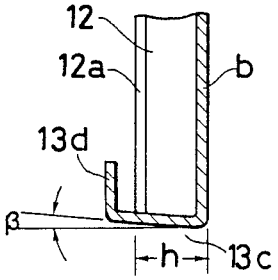
Figure 5:
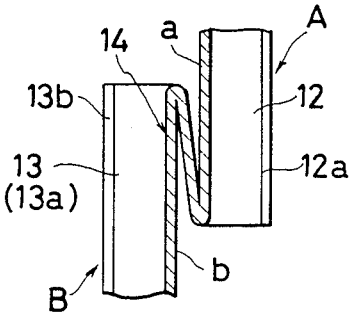

FIG. 1 through FIG. 7 illustrate a first embodiment of this invention. This first embodiment is suitable for metallic panels made of such a material as aluminum alloy plate which is relatively easy of plastic fabrication. A metallic panel 11 formed by pressing the aforementioned material comprises a first part A constituting the upper part of the panel and destined to be left exposed as disposed in a completely covered roof. A rising rib 12 is formed along the edge of the first part A formed in the shape of an isosceles triangle in the upper part of the metallic panel 11 in the shape of a pentagon as illustrated in the diagram and a falling rib 13 is formed along the edge of the second part B assuming the shape of a rectangle in the lower part of the metallic panel 11. The metallic panel 11 is folded in a cross section of the letter Z along the boundary between the first part A and the second part B so as to form an engaging portion 14 with the lower end of the first part A doubled up over the upper end of the second part B (FIG. 5).

Figure 2:
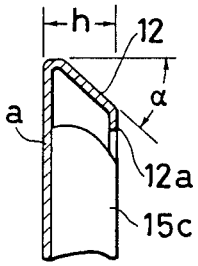

The rising rib 12 mentioned above is formed by bending the edge portion of the panel surface a in the first part A obliquely in an upper inward direction in the height of h. The inclination of the rising rib 12 relative to the plane perpendicular to the panel surface a is about 45 degrees. Further this rising rib 12 is provided at the upper edge thereof with a portion 12*a* extended to a stated length parallel to the panel surface a (FIG. 2).

The falling rib 13 is formed by bending the edge portion of the panel surface b of the second part B in a downward direction and then further in an inward direction. To be more specific, the opposite lateral falling ribs 13*a* in the whole falling rib 13 are formed perpendicularly relative to the panel surface b or in a state slanted inwardly by an angle $\beta$ from the perpendicular to the panel surface, as thrust downwardly to a height h. From the lower ends of the falling ribs 13*a*, extended portions 13*b* of a width w are thrust out as disposed parallelly to the panel surface b mentioned above. The statement that the edge portions are bent downwardly and further inwardly embraces the case in which they are bent obliquely in an inner downward direction from the panel surface (FIG. 3). Further, along the lower end side edge of the second part B, the edge portion of the panel surface b is bent downwardly similarly to the falling ribs 13*a* and thrust downwardly further past the amount h of downward thrust of the opposite falling ribs 13*a*, 13*a* to give rise to a falling rib 13*c*. From the lower end edge of this falling rib 13*c*, an engaging portion 13*d* is formed as bent inwardly. Again in this case, the angle $\beta$ may be reduced to nil, namely, the falling rib 13*c* may be perpendicular relative to the panel surface b. A falling rib identical in structure to the opposite lateral falling ribs is also embraced (FIG. 4). This engaging portion 13*d* is intended to be joined with an engaging portion 14 formed as folded in a cross section of the letter z in another metallic panel already laid underneath when the metallic panel 11 is set in covering a roof. By this union, the metallic panel is fixed in position. The union thus established serves the purpose of preventing rainwater from being blown in through the lower end of the metallic panel and, at the same time, of keeping the lower end of the metallic panel down fast in place against an upward current of wind in a storm.

On the first part A, four pairs of oblong reinforcing protuberances 15*a*, 15*b*, 15*c* and 15*d* are parallelly disposed to the perpendicular drawn from the apex T to the base of the first part A which assumes the shape of an isosceles triangle as illustrated in the diagram, with the members of each of the pairs arranged symmetrically relative to the perpendicular. The total of eight reinforcing protuberances 15*a* to 15*d* are formed with a height equal to the height of the rising rib 12 in a substantially semicircular cross section. Among all the pairs of reinforcing protuberances, the pair of reinforcing protuberances 15*a*, 15*a* located nearest to the perpendicular have the largest length. The pairs 15*b*, 15*c*, and 15*d* are increasingly separated from the perpendicular are progressively shorter.

Figure 6:
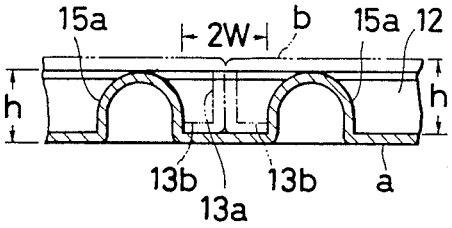
Figure 7:
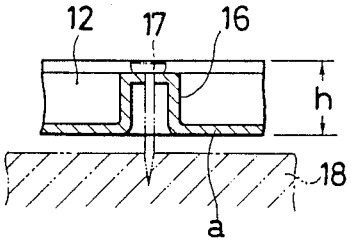

The distance between the reinforcing protuberances 15*a*, 15*a* is twice the width w of the extended portions 13*b* of the falling ribs 13*a* formed one each on the opposite sides of the second part B of the metallic panel 11. The individual reinforcing protuberances 15*a*, 15*b*, 15*c* and 15*d* are desirably separated with substantially equal intervals (FIG. 1 and FIG. 6).

The first part A is further provided at a level nearly halving the height of the isosceles triangle thereof between the reinforcing protuberances 15*b* and the reinforcing protuberances 15*c* with cylindrical nailing bosses 16 which are disposed symmetrically relative to the perpendicular mentioned above (FIG. 7). Notwithstanding the diagram illustrating a preferred disposition, these bosses may be suitably positioned.

In covering a roof with the metallic panels 11, metallic panels 11 are arrayed in one horizontal row along the lowermost end in the inclination of the roof, with the lateral faces of the falling ribs 15 defining the opposite lateral sides of the second part B of the metallic panels 11 held in tight contact and the metallic panels 11 are fixed to the roof sheathing or rafters 18 by driving nails 17 into the nailing bosses 17 and metallic panels 11 are placed similarly in a second row.

The metallic panels 11 in the second row are placed so that the engaging portions 13*d* formed along the lower ends oft he second parts B of the metallic panels 11 are joined to the engaging portions 14 folded in a cross section of the letter Z in the metallic panels 11 of the first row, the falling ribs 13*a* of the second parts B, B of the adjacent metallic panels 11, 11 in the second row adjoin at the positions corresponding to the centers of the first parts A of the metallic panels 11 in the first row, and the extended portions 13*b*, 13*b* of the falling ribs 13*a* are fitted between the reinforcing protuberances 15*a*, 15*a* of the metallic panels 11 in the first row. Then, the metallic panels 11 in the second row are nailed down fast. This procedure is repeated in the placement of metallic panels in the third and subsequent rows gradually upwardly until the roof is completely covered.

In the metallic panel 11 of the present embodiment, since the rising rib 12 along the edge of the first part A and the falling rib 13 along the edge of the second part B are formed by bending the relevant edge portions of the panel in inward directions, the ribs 12 and 13 ensure perfect prevention of the rainwater impinging upon the panel surface from flowing out of the panel and serve the purpose of protecting the roof against leakage of rain.

Since the engaging portion 14 is formed along the boundary between the first part A and the second part B by folding the metallic panel in a cross section of the letter Z and this engaging portion 14 is adapted to take fast hold of the engaging portion 13*d* which is formed along the lower end of thesecond part B of another metallic panel 11, the union of these engaing portions permits the relative positioning of metallic panels 11 in the vertical direction along the inclination of the roof to be attained automatically and, at the same time, prevents rainwater from leaking through the lower end of the metallic panel and effectively keeps the metallic panels 11 held down fast during a storm.

When the rising rib 12 and the falling rib 13 are respectively provided with the extended portions 12*a*, 13*a*, these extended portions 12*a*, 13*b*, and 13*d* prevent the rainfall impinging on the panel surface a from flowing out of the metallic panel and reliably protect the roof against leakage of rain even if the roof is sloped gently and the rainwater is blown upwardly along the slope of the roof by a strong wind. They also serve the purpose of preventing the finished surface of the other metallic panel 11 held in contact with the upper or lower end of each of the ribs of the metallic panel from sustaining damage. They are further capable of preventing the panel surface b from sharply sagging down under a load exerted upon the roof when a person walks thereon. When the rising rib 12 and the falling rib 13 are slightly slanted, they avoid coming into perpendicular contact with the other metallic panel 11. When a load is exerted upon the metallic panel as when a person walks on the roof, the load can be easily absorbed by the ribs 12, 13 changing their angles of bending. Since the deformation caused in the ribs. 12, 13 can be retained within the range of elasticity, the ribs 12, 13 can return to their original shape and the panel surface b, etc. are protected from being permanently deformed. The rising rib in the proximity of the apex T of the first part A possesses high rigidity because of its particular construction. When a load is exerted downwardly thereon from above, therefore, the rising rib undergoes deformation and does not easily absorb the load. This portion is not deformed by the load exerted as when a person walks on the roof because this portion itself is positioned slightly above the upper end of the second part B of the other metallic panel 11 laid on the present metallic panel (the position of the engaging portion 14 formed by folding the panel in a cross section of the letter (Z) and further because the neighborhood of the lower end of the second part B, namely a portion of relatively high rigidity due to the presence of the engaging portion 14 formed by folding the metallic panel in a cross section of the letter Z and the presence of the reinforcing protuberances 15*a*, 15*a*, is disposed on the rising rib 12 near the apex T.

The opposed falling ribs 13*a* of the adjacent metallic panels are allowed to adjoin each other between the two reinforcing protuberances. This arrangement enables the relative positioning of metallic panels 11 being placed on the roof in the lateral direction to be attained automatically and permits perfect protection of the roof against leakage of rain because the rainwater finding its way between the exposed parts B of the overlying metallic panels 11 is collected between the two reinforcing protuberances 15*a*, 15*a* mentioned above and the collected rainwater is prevented from being diffused but is allowed to flow down the slope of the roof between the reinforcing protuberances 15*a*, 15*a*.

Further, when the rising rib 12, the falling rib 13, and the reinforcing protuberances 15*a* to 15*d* of the metallic panels are formed in the same height, the roof completely covered with the metallic panels 11 assumes a flat and smooth finished surface and permits effective dispersion of the load exerted thereon as when a person walks on the roof, prevents the metallic panels 11 from sustaining damage and enhances the effect in precluding entry of rainwater.

Figure 8:
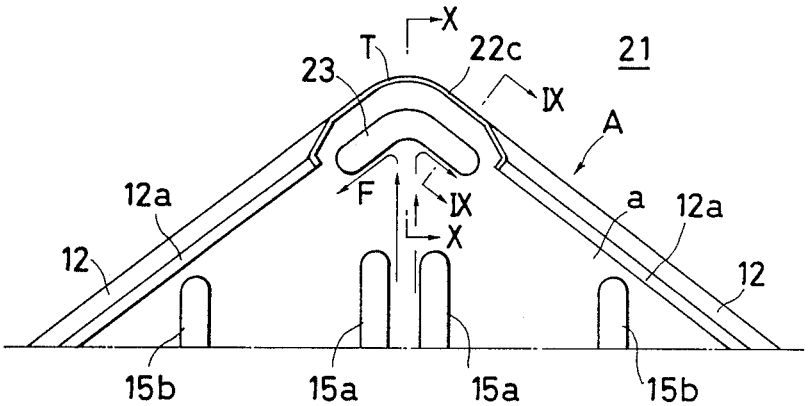
FIG. 8 is a plan view of the essential part of a typical metallic panel as the second embodiment of this invention, FIG. 9 a cross section taken through FIG. 8 along the line IX—IX, and FIG. 10 a cross section taken through FIG. 8 along the line X—X.
Figure 9:
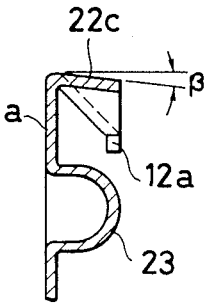
Figure 10:
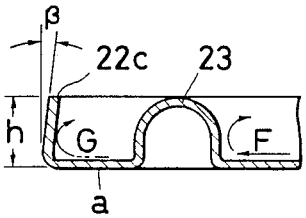

FIG. 8 to FIG. 10 illustrate a second embodiment of the present invention. Specifically, this embodiment consists in a metallic panel which is made of a material such as stainless steel sheet which is relatively difficult of production due to low plastic deformability. In the diagrams, corresponding component parts to those of the preceding diagrams of the first embodiment are denoted by like reference numerals.

A metallic panel 21 is formed by pressing the aforementioned material and comprises a first part A in the shape of an isosceles triangle and a rectangular second part (not shown) continuing into the lower portion of the first part A. The first part A, similarly to that in the metallic panel of the first embodiment, is provided along the edge thereof with a rising rib 12 which is bent inwardly at an angle of about 45 degrees relative to the panel surface a of the metallic panel 21 and, at the same time, furnished at the upper end thereof with an extended portion 12*a*. The second part is provided at the opposite lateral edges thereof with falling ribs which are each furnished at the lower end thereof with an extended portion. This second part is further provided along the lower end thereof with an engaging portion.

In the first part of the metallic panel of the present embodiment, the rising rib 22*c* in the neighborhood of the apex T lacks an extended portion 12*a* as illustrated in FIG. 8. This rising rib 22*c* is inclined inwardly (in the downward direction in the position shown in FIG. 9) by an angle of $\beta$ relative to the perpendicular line. This angle $\beta$ gradually widens as the distance from the apex T increases. Owing to this gradual increase of the angle, this rising rib 22*c* is allowed to continue naturally into the rising ribs 12 on the opposite oblique sides of the triangle (FIG. 8). In this case, the panel material to be finished by pressing may be formed so as to acquire a required shape when it is pressed for finishing.

On the panel surface a of the first part A mentioned above, four pairs of reinforcing protuberances (only the two pairs, 15*a*, 15*a*, 15*b*, and 15*b* shown in the diagram) are formed similarly to those on the metallic panel of the first embodiment. The reinforcing protuberances 15*a*, 15*a* of the centermost pair are separated by a distance just large enough for the opposed falling ribs of other adjacent metallic panels 21, 21 laid over the present metallic panel to join to each other without any gap. Then, on the panel surface a between these two reinforcing protuberances 15*a*, 15*a* and the rising rib 22*c* in the neighborhood of the apex T, an arcuate combination reinforcing and stopping protuberance 23 is formed as laid parallelly to the rising rib 22*c* in the proximity of the apex T.

The metallic panel 21 requires only moderate plastic deformation when it is formed by pressing because the rising rib 22c in the proximity of the apex T of the first part A lacks an extended portion and the rising rib is substantially perpendicular to the panel surface a. Even when the metallic panel 21 is made of stainless steel sheet which does not readily yield to plastic working as by drawing, therefore, it can be formed easily by pressing without entailing occurrence of a crack in the rising rib 22c in the proximity of the apex T.

Since the conbination reinforcing and stopping protuberance 23 is formed in the manner described above, the rainwater reaching the panel surface as when the roof is gently inclined and then caused by a strong wind to flow backwardly on the panel surface a in the direction of the arrow F as shown in FIG. 8 and FIG. 10 is prevented by the stopping protuberance 23 from flowing in the direction of the apex T. Even if the rainwater should happen to reach the neighborhood of the apex T, the rising rib 22c prevents the invading rainwater from flowing off the panel as shown by the arrow G in FIG. 10. Thus, the roof covered with the metallic panels of the construction described above is reliably protected from leakage of invading rainwater.

Figure 11:
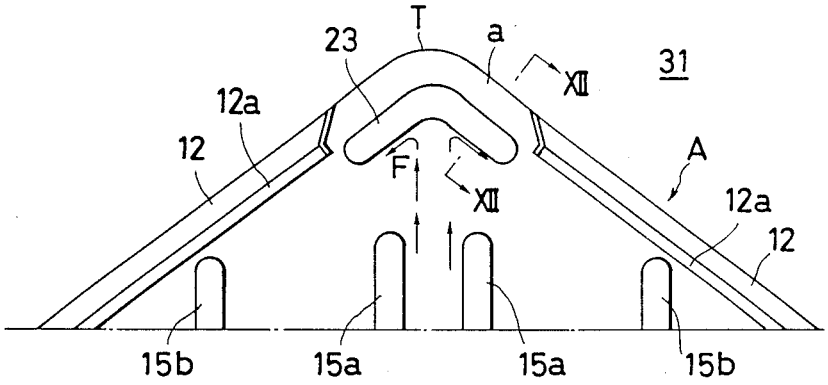
FIG. 11 is a plan view of the essential part of a typical metallic panel as the third embodiment of this invention and FIG. 12 a cross section taken through FIG. 11 along the line XII—XII.
Figure 12:
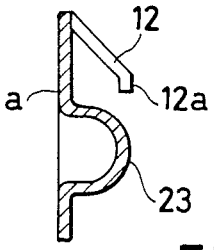
Figure 13:
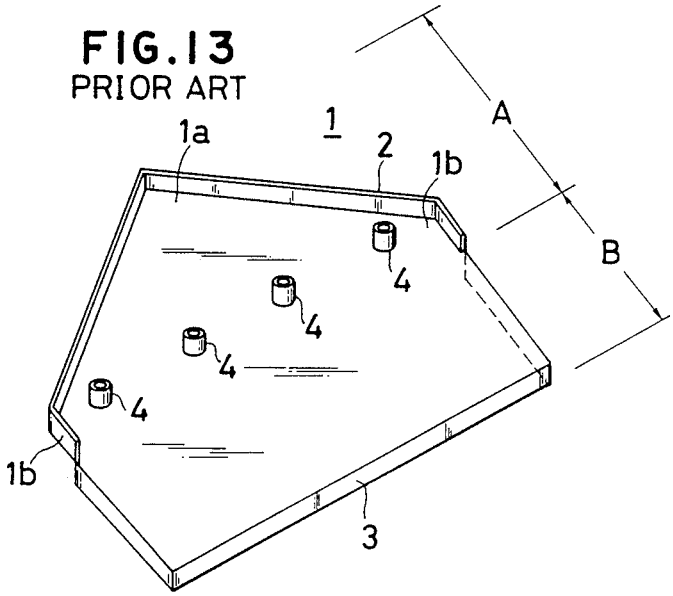
FIG. 13 PRIOR ART
FIG. 13 is a perspective view of a typical metallic panel as an embodiment of the prior art, FIG. 14 a bird's-eye view illustrating the condition in which the metallic panel is put to use, and FIG. 15 a cross section illustrating the condition of actual use.
Figure 14:
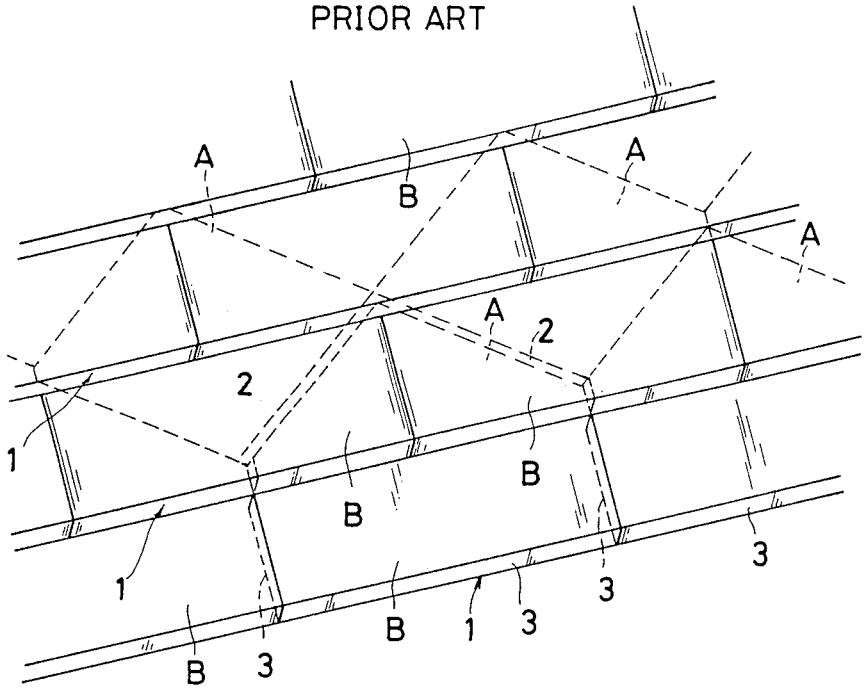
FIG. 14 PRIOR ART
Figure 15:
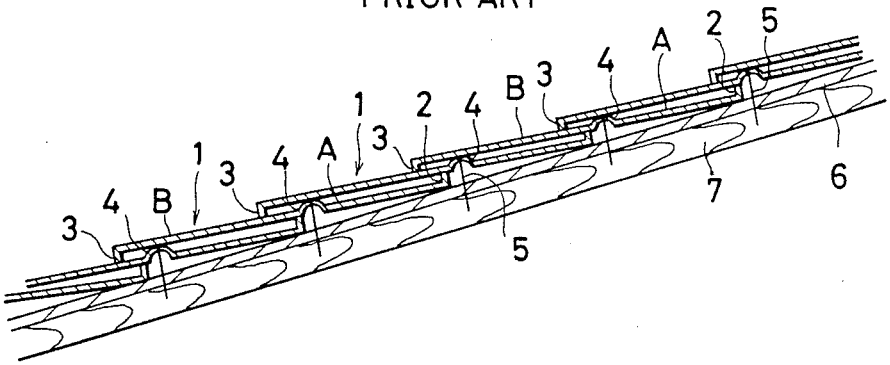
FIG. 15 PRIOR ART

FIG. 11 and FIG. 12 illustrate a third embodiment of the present invention. This embodiment consists in a metallic panel which, similarly to the second embodiment, is made of a material such as stainless steel sheet which does not readily yield to plastic working. In the diagrams, corresponding component parts to those of the second embodiment will be denoted by like reference numerals and will be omitted from a further description.

In a metallic panel 31, a rising rib 12 bent inwardly by an inclination of about 45 degrees relative to the panel surface a is formed along the edges of the two oblique sides of the first part A having the shape of an isosceles triangle, except in the neighborhood of the apex T. The rising rib of this construction can be easily formed when the portion of the stainless steel sheet destined to constitute the rising rib in the proximity of the apex T, a portion which would require strong plastic deformation, is cut off before the panel material is worked by pressing. Then, inside the apex T in which the rising rib 12 is not formed around the first part A, a combination reinforcing and stopping protuberance 23 is arcuately formed, similarly to the metallic panel of the second embodiment described above, along the contour near the apex T.

The neighborhood of the apex T of the first part A which requires strong plastic deformation during the working with a press is formed in the shape of a flat sheet by omitting the rising rib 12. The work of pressing to be performed on this portion of the panel material, therefore, is limited to simple bending and punching of an arcuate groove. Thus, the work of pressing itself is simple and a wider variety of materials become usable for this metallic panel.

Even when the rainwater making its way to the panel surface a in the first part A of the metallic panel 31 is caused by a strong wind to flow back upwardly, the stopping protuberance 23 prevents the rainwater from flowing in the direction of the apex T similarly to the second embodiment. As a result, the flow of the invading rainwater off the panel and leakage of the invading rainwater through the roof can be prevented reliably. since the portion of the apex T in which the rising rib 12 of the metallic panel 31 is not formed plays the role of an opening for ventilation, the air is allowed to flow freely through the spaces defined severally by the metallic panels 31. This free flow of the air through the spaces precludes the possibility that any difference of air pressure occurring inside and outside the orifices formed where the upper and lower surfaces of the successively overlaid metallic panels 31 overlap will cause suction of rainwater during a storm. Thus, the leakage of rainwater through the roof due to this suction of rainwater is prevented. Where the roof is inclined so gently as to entail the risk of invading rainwater flowing backward and leaking through the roof, this risk can be eliminated by covering the tops of the overlapping portions with cap-like parts formed of resin, for example.

In the embodiments cited so far, the metallic panels have been described as intended for use in covering a roof. Notwithstanding the description, they can also be used as facing materials for walls. As concerns the material for the metallic panel, iron type metals such as are used in ordinary steel plates and nonferrous metals such as are used in copper plates may be used in place of aluminum alloy or stainless steel.

As described above, the metal roofing and siding panel of this invention is provided along the e dge of the first part thereof destined to be overlaid by another metallic panel with a rising rib formed by bending the edge portion thereof in an upper inward direction, along the edge of the second part thereof destined to be left exposed even after the metallic panel is overlaid by another metallic panel with a falling rib formed by folding the edge portion thereof in a lower inward direction, and on the first part with a plurality of oblong reinforcing protuberances formed in the vertical direction, i.e. the direction in which water flows spontaneously. In this construction, the reinforcing protuberances cause the rainwater reaching the first part to flow down the first part onto the second part. Even when the invading rainwater is caused by a strong wind to flow backward in the upper direction, the ribs will still reliably prevent the invading rainwater from flowing off the panel. Thus, the roof is protected from leakage of rainwater

What is claimed is:

1. A metal roofing and siding panel comprising:

a first part having the shape of an isosceles triangle, having a rising rib formed along the sides of said isosceles triangle by folding the sides in an upper inward direction, and having plural pairs of oblong reinforcing protuberances formed on the obverse side thereof and arranged in parallel with a line perpendicular to the base of said triangle; and a second part having the shape of a rectangle, having a falling rib formed along the two short sides and one long side of said rectangle by folding the two short sides and one long side in a lower inward direction;

the base of said isosceles triangle and the other long side of said rectangle being connected with a folded structure;

one of said plural pairs of oblong reinforcing protuberances nearest the perpendicular of said triangle having a space substantially equal to twice the width of said falling rib, wherein a plurality of said metal roofing and siding panels may be arrayed in a plurality of rows so that the reverse sides of respective halves of the second parts of two of said plurality of roofing and siding panels in a second row are caused to contact the obverse side of the first part of any one of said plurality of metal roofing and siding panels in a first row, with the falling ribs on the opposed respective short sides of the second parts of two panels in the second row fitted in the space between the pair of oblong reinforcing protuberances on the first part of the one panel in the first row and with the respective halves of the falling ribs on the other respective long sides being held by the folded structure of the one panel in the first row to leave the obverse sides of the second parts exposed.

2. The metal roofing and siding panel according to claim 1 wherein said oblong reinforcing protuberances, said rising rib of the first part and said falling rib of the second part have substantially the same height.

3. The metal roofing and siding panel according to claim 1 wherein the length of the perpendicular of the isosceles triangle is greater than the length of the short sides of the rectangle.

4. The metal roofing and siding panel according to claim 1 wherein said first part is provided with a pair of cylindrical nailing bosses disposed symmetrically relative to the perpendicular of the isosceles triangle.

* * * * *